US008858289B2

(12) United States Patent
Forte

(10) Patent No.: US 8,858,289 B2
(45) Date of Patent: Oct. 14, 2014

(54) LIGHTED FLYING DISC

(75) Inventor: Chad Forte, Aurora, CO (US)

(73) Assignee: Nite Ize, Inc., Boulder, CO (US)

( * ) Notice: Subject to any disclaimer, the term of this patent is extended or adjusted under 35 U.S.C. 154(b) by 151 days.

(21) Appl. No.: 12/763,160

(22) Filed: Apr. 19, 2010

(65) Prior Publication Data

US 2011/0104977 A1 May 5, 2011

Related U.S. Application Data

(60) Provisional application No. 61/170,871, filed on Apr. 20, 2009.

(51) Int. Cl.

| | |
|---|---|
| ***A63H 27/00*** | (2006.01) |
| ***A63H 33/18*** | (2006.01) |
| *A63H 33/26* | (2006.01) |

(52) U.S. Cl.

CPC ..... *A63H 33/18* (2013.01); *A63H 33/26* (2013.01)

USPC ..... 446/47; 446/242

(58) Field of Classification Search

USPC ..... 446/47, 242

See application file for complete search history.

(56) References Cited

U.S. PATENT DOCUMENTS

| | | | | |
|---|---|---|---|---|
| 3,911,264 | A * | 10/1975 | Chao | 446/439 |
| 3,948,523 | A | 4/1976 | Michael | |
| 4,223,473 | A | 9/1980 | Brown | |
| 4,241,533 | A | 12/1980 | Newsome | |
| 4,253,672 | A | 3/1981 | Milzoff et al. | |
| 4,290,226 | A | 9/1981 | Stauffer | |
| 4,301,616 | A | 11/1981 | Gudgel | |
| 4,915,666 | A * | 4/1990 | Maleyko | 446/242 |
| 5,078,637 | A * | 1/1992 | McFarland | 446/46 |
| 5,108,340 | A * | 4/1992 | Farrow | 446/242 |
| 5,261,846 | A | 11/1993 | Hanna | |
| 5,611,720 | A * | 3/1997 | Vandermaas | 446/47 |
| 5,720,651 | A * | 2/1998 | Chien | 451/95 |
| 5,931,716 | A | 8/1999 | Hopkins et al. | |
| 6,113,453 | A * | 9/2000 | Stuffelbeam | 446/46 |
| 6,193,620 | B1 * | 2/2001 | Tarng | 473/465 |
| 6,547,623 | B1 * | 4/2003 | Collado | 446/47 |
| 6,726,521 | B2 * | 4/2004 | Peterson | 446/46 |
| 6,840,655 | B2 * | 1/2005 | Shen | 362/249.04 |
| 7,018,067 | B2 * | 3/2006 | Wu | 362/249.04 |
| 7,223,150 | B2 | 5/2007 | Chernick et al. | |
| 7,347,758 | B2 * | 3/2008 | Moore | 446/47 |
| 2003/0068954 | A1 * | 4/2003 | Oblack | 446/34 |
| 2004/0212992 | A1 * | 10/2004 | Chen | 362/227 |

(Continued)

*Primary Examiner* — Gene Kim
*Assistant Examiner* — Alyssa Hylinski
(74) *Attorney, Agent, or Firm* — Squire Patton Boggs (US) LLP

(57) ABSTRACT

A soft, flexible, illuminating flying disk toy may be used for recreation by adults and children and as a fetch toy for animals. The disk is designed as an improvement to existing soft, flexible flying disks by incorporating an illuminated outer edge, typically battery powered. This illuminated outer edge, while sewn into a durable, light weight, tear resistant translucent material, will also provide the semi-rigid support needed to create and maintain stable flight. The illuminated outer edge which is sewn into the translucent durable material is then sewn onto a slightly over-sized central circular disk shaped section of the same or similar material which, when thrown, creates an aerodynamic lift providing stable flight. By incorporating the illuminated outer edge into a soft flying disk, visibility and additional safety are provided when using the disk in dimming light conditions and during the dark of night.

13 Claims, 9 Drawing Sheets

(56) References Cited

U.S. PATENT DOCUMENTS

2005/0092258 A1* 5/2005 Markham ..... 119/707
2005/0255787 A1* 11/2005 Pak ..... 446/236
2007/0206375 A1* 9/2007 Piepgras et al. ..... 362/147
2008/0053380 A1* 3/2008 Ritchey et al. ..... 119/707
2009/0199784 A1* 8/2009 Oblack et al. ..... 119/707

* cited by examiner

LIGHTED FLYING DISC

CROSS-REFERENCES TO RELATED APPLICATIONS

This application claims the benefit of U.S. Provisional Application Ser. No. 61/170,871 filed on Apr. 20, 2009 titled "LIGHTED FLYING DISC" which is incorporated herein by reference in its entirety for all that is taught and disclosed therein.

BACKGROUND

Disk shaped throwing toys have been constructed from molded hard plastic as well as durable tear resistant fabric material incorporating a rigid outer edge. The soft type of throwing disk is particularly favorable when being used by children, in crowed areas, or when thrown to dogs or other animals. The throwing disks made of molded hard plastic are capable of more damage or injury if a child or adult should unexpectedly be struck by one, and may damage an animal's mouth or teeth when the animal tries to catch the disk.

SUMMARY

This Summary is provided to introduce in a simplified form a selection of concepts that are further described below in the Detailed Description. This Summary is not intended to identify key features or essential features of the claimed subject matter, nor is it intended to be used to limit the scope of the claimed subject matter.

The present invention relates to disk shaped throwing toys, and particularly to an improvement to soft flexible throwing disks which are made of a durable tear resistant fabric material having a semi-rigid outer edge. This type of throwing disk is particularly favorable when being used by children, in crowed areas, or when thrown to dogs or other animals. The flexible throwing disk is made of a durable tear resistant fabric material and incorporates a lighted sewn in edge which makes the disc visible in dim light or dark conditions with less chance of being lost and with more chance of retrieval by a child or dog that would be able to easily locate it.

DETAILED DESCRIPTION

Figure 1:
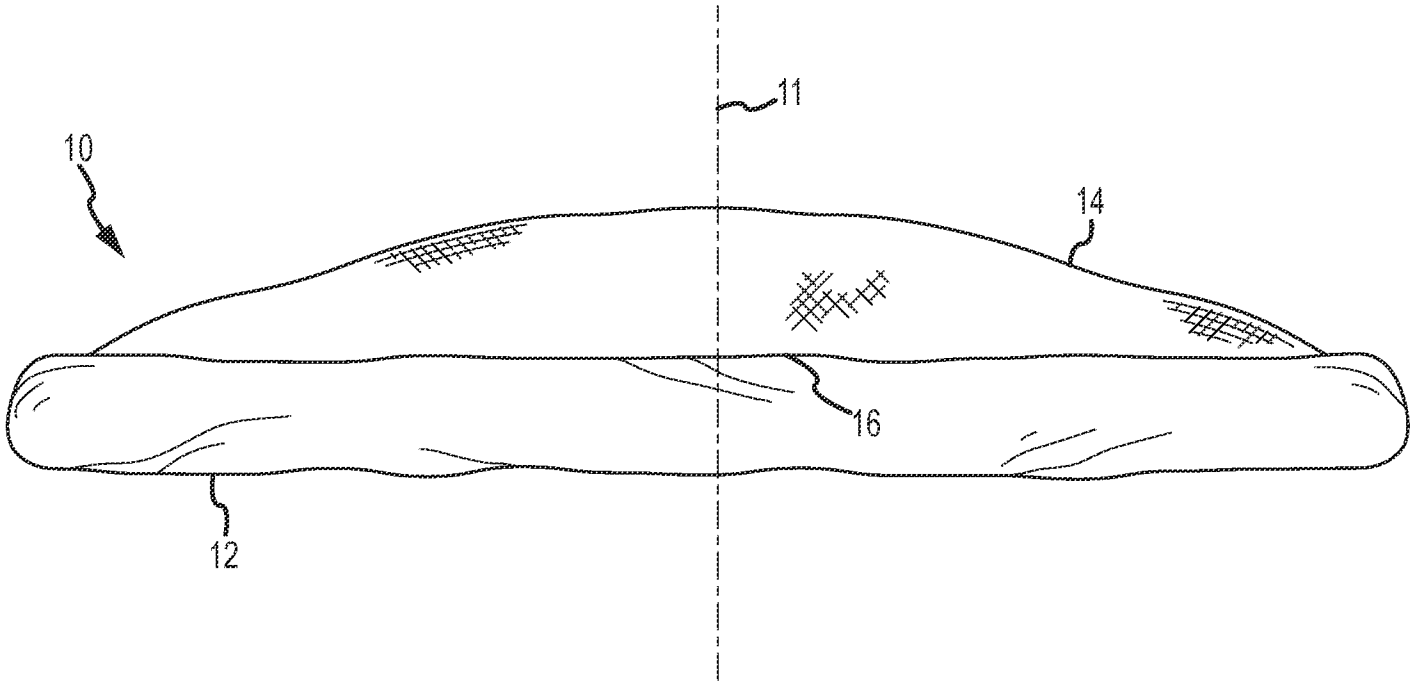
FIG. 1 shows an elevation view of the disk in flying motion with the air underneath it creating the air foil properties needed for stable flight.

Referring now to the Figures, like reference numerals and names refer to structurally and/or functionally similar elements thereof, and if objects depicted in the figures that are covered by another object, as well as the tag line for the element number thereto, may be shown in dashed lines. FIG. 1 shows an elevation view of the disk in flying motion with the air underneath it creating the air foil properties needed for stable flight. Referring now to FIG. 1, Disk 10 is a soft, flexible, buoyant, and lighted throwing disk. Soft Body Portion 14 is flexible and is made of a durable tear resistant circular piece of fabric material such as 400-500 denier nylon pack cloth, rip stop nylon, hemp cloth, cotton, or a similar durable tear resistant material. One advantage of Disk 10 relates to semi-rigid Edge 12 which comprises a hollow circular fold of soft fabric, which may be made of the same material as Soft Body Portion 14. Edge 12 is large enough to create an air pocket to act as an air foil creating lift while flying through the air resulting in stable flight. For aesthetic reasons, Soft Body Portion 14 and the hollow circular fold of soft fabric of Edge 12 are typically made of different color material, but they can be the same color. Edge 12 contains a Hollow Tube 20 which contains a Light Tube 21 (See FIG. 3). Hollow Tube 20 is typically made of a clear or translucent material, such as plastic, PVC, or rubber, which allows light to travel through it. The material should be durable enough to withstand impacting the ground or other immovable objects. Light Tube 21 will be rigid enough to maintain its shape, while at the same time being flexible enough to not cause serious harm to a child, adult, or animal, or a vehicle, glass window, interior or exterior wall or the like. The material should also be durable enough to withstand the pressure of an animal's biting down on it when used as a throw toy for pets. The color of the hollow circular fold of soft fabric of Edge 12 is also light enough to allow Light 18 from Light Tube 21 to escape from Edge 12 (See FIG. 3).

Hollow Tube 20 enclosed within the circular fold of soft fabric of Edge 12 provides structural support to Disk 10, allowing Disk 10 to maintain a disk-like shape. See also FIG. 9 which shows Edge 12 in cross-section. Hollow Tube 20 is bendable and flexible. Existing disks known in the art have an outer edge comprised of rubber, plastic, foam or a like material to create buoyancy and maintain the disk's shape during flight, but are typically much more rigid than Edge 12 of Disk 10. Disk 10 adds to and improves upon those attributes. Soft Body Portion 14 and the hollow circular fold of soft fabric of Edge 12 may be separate pieces, or one unitary piece. In either case, Seam 16 secures Soft Body Portion 14 to Edge 12. Seam 16 is typically a single or double stitched seam, but could be any other type or method of joining two edges together. When in flight as shown in FIG. 1, Disk 10 spins about Axis 11, which is substantially perpendicular to Soft Body Portion 14, in either direction depending upon how Disk 10 is thrown. A right-handed person will typically throw Disk 10 with a clockwise spin, whereas a left-handed person will typically throw Disk 10 with a counter-clockwise spin. Soft Body Portion 14 is a slightly over-sized central circular disk shaped section bounded by Edge 12 which, when thrown, creates an aerodynamic lift providing stable flight. Soft Body Portion 14 rises in flight due to its over-size and because of the differences in air pressure above and below Disk 10, causing Soft Body Portion 14 to have the rounded or dome shape shown in FIG. 1.

Figure 2:
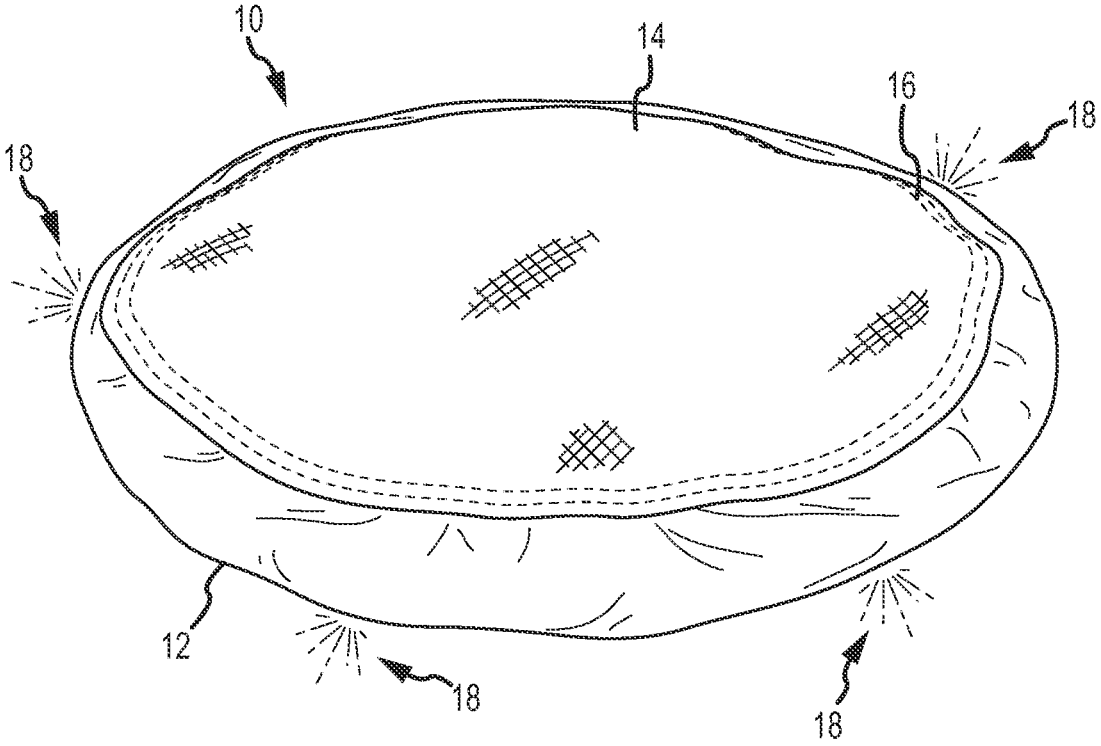
FIG. 2 shows a top perspective view of the disk depicting the seam connecting the edge to the top portion of material.

FIG. 2 shows a top perspective view of the disk depicting the seam connecting the edge to the top portion of material. Referring now to FIG. 2, Seam 16 is typically a single or double stitched seam attaching Soft Body Portion 14 to the hollow circular fold of soft fabric of Edge 12 which houses Hollow Tube 20. Edge 12 is shown emitting Light 18 (See also FIG. 3).

Figure 3:
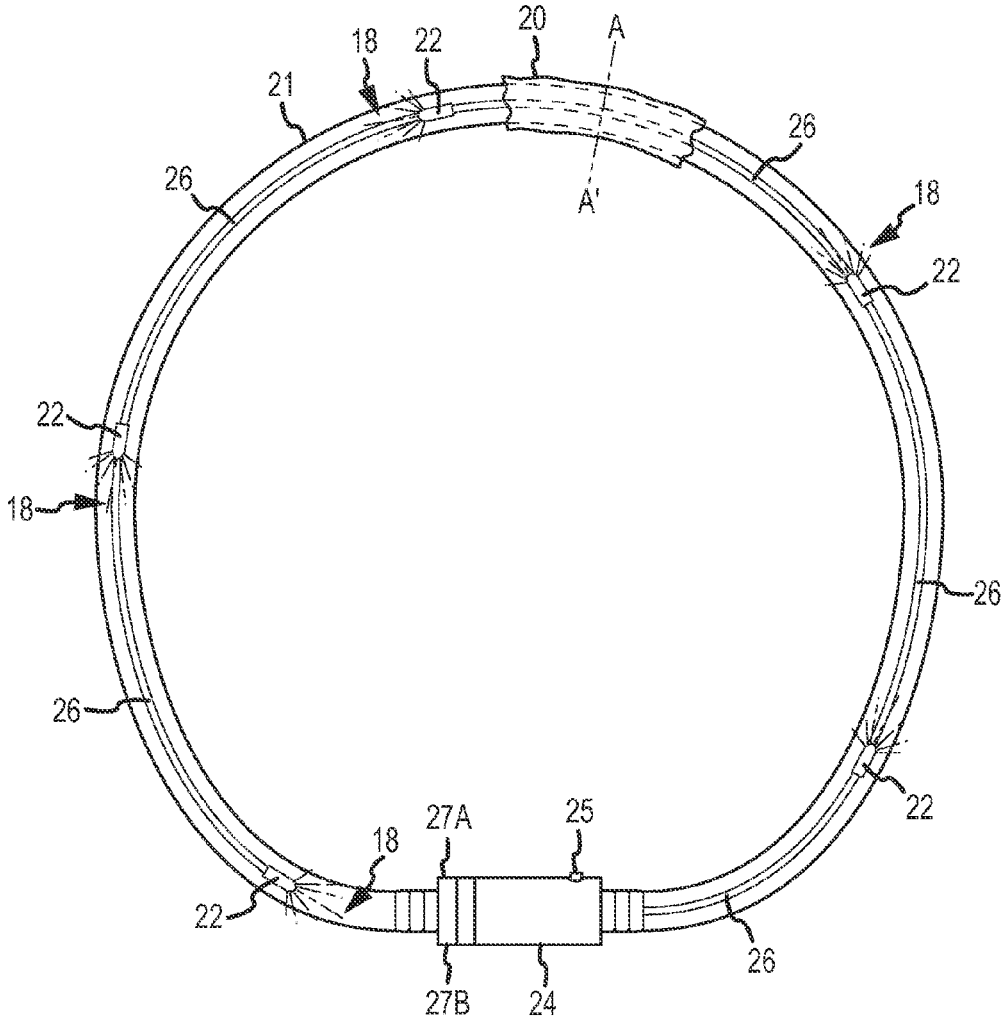
FIG. 3 shows a hollow tube incorporating a light tube having multiple light-emitting diodes and a power switch and a point of separation.

FIG. 3 shows a hollow tube incorporating a light tube having multiple light-emitting diodes and a power switch and a point of separation. Referring now to FIG. 3, Light Tube 21 is contained within Hollow Tube 20 (only a portion of Hollow Tube 20 is shown in FIG. 3 so the detail of Light Tube 21 can be more clearly seen. See also FIG. 9 for a cross-section view along line A-A'). Light Tube 21, which is also flexible and bendable like Hollow Tube 20, houses a plurality of light emitting diodes (LED's) 22 which emit Light 18. Light Tube 21 is typically water tight and weather resistant. In addition to LED's 22, other light devices may be used, such as fiber optic strands, incandescent lighting, laser lights, or other similar light emitting technology. LED's 22 may have a thermoplastic polymer lens enhancing the light emitted. LED's 22 are attached to Power Housing 24 through pairs of Leads 26. Power Housing 24 typically contains one or more Batteries 28 (See FIG. 5), such as CR927, AG3, or AG13 batteries. Power Switch 25 switches the power on and off, and may be a push-button type switch, a sliding multiple position slide switch, or any other suitable switch. Power Switch 25 is typically weather resistant and may be made of a durable, flexible material such as PVC, rubber, plastic or the like. At Connection Point 27A and 27B, one end of Light Tube 21 connects to the other end, forming a circle, typically through a pressure or snap type fitting, where one end of Light Tube 21 has a smaller diameter that fits into, with friction or a snap, a larger diameter of the other end. Hollow Tube 20 may have a similar type fitting at Connection Point 27A and 27B. Having Light Tube 21 contained within Hollow Tube 20 provides extra protection for LED's 22, Leads 26, and Power Housing 24. In other embodiments of the invention, only Light Tube 21 is contained within the hollow circular fold of soft fabric of Edge 12. In such cases, the thickness of Light Tube 21 may be increased to provide more protection for LED's 22, Leads 26, and Power Housing 24.

Figure 4:
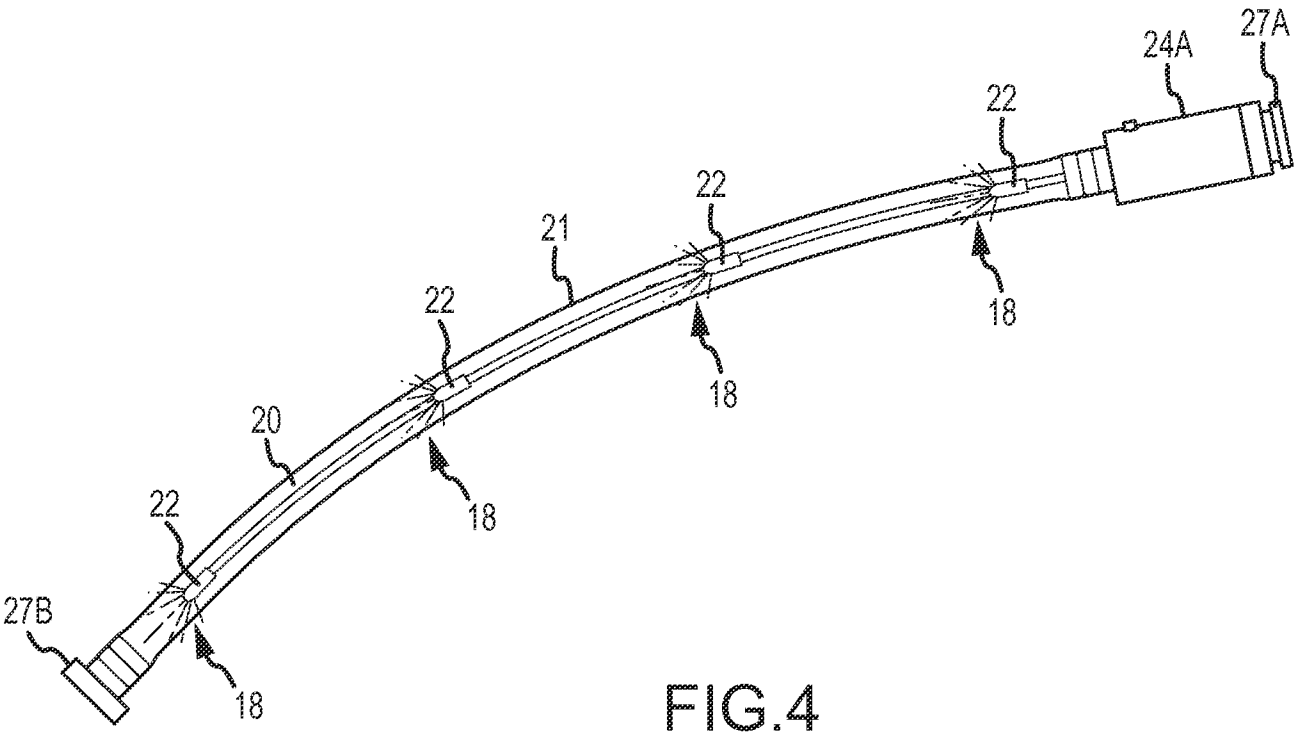
FIG. 4 shows the light tube separated at a point of separation and in a straightened position.

FIG. 4 shows the light tube separated at a point of separation and in a straightened position. Referring now to FIG. 4, Light Tube 21 is shown disconnected at Connection Point 27A and 27B. There is no electrical connection at Connection Point 27A and 27B. This is simply where the two differing diameters of Light Tube 21 fit together. The ability to separate Light Tube 21 at Connection Point 27A and 27B can aid in the ease of sewing Light Tube 21 and Hollow Tube 20 into Disk 10.

Figure 5:
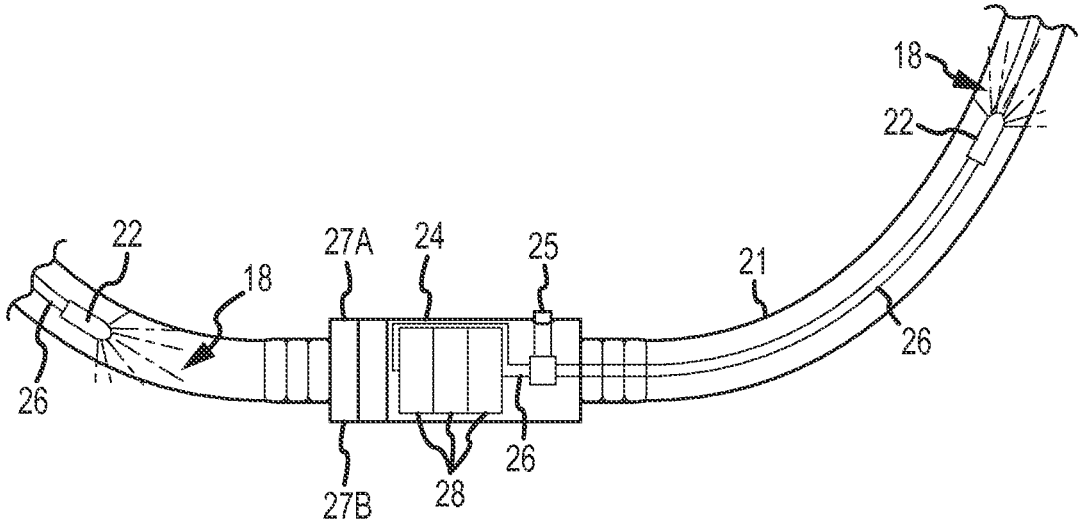
FIG. 5 shows the power switch and battery enclosure.

FIG. 5 shows the power switch and battery enclosure. Referring now to FIG. 5, one or more Batteries 28 located within Power Housing 24 provide power to the plurality of LED's 22 when Power Switch 25 is activated. Power Switch 25 may connect circuits within Power Housing 24 that are designed to turn the plurality of LED's 22 on and off in various patterns, modes, or sequences to achieve pleasing visual effects. For example, pressing Power Switch 25 once or sliding Power Switch 25 to a first position may activate a first circuit that causes the plurality of LED's 22 to turn on and turn off in sequence, giving the appearance of Light 18 traveling in a circular pattern within Edge 12. Pressing Power Switch 25 a second time or sliding Power Switch 25 to a second position may activate a second circuit that causes the plurality of LED's 22 to turn on and turn off in tandem, giving a strobe-like appearance to Light 18 within Edge 12. Pressing Power Switch 25 a third time or sliding Power Switch 25 to a third position may activate a third circuit that causes the plurality of LED's 22 to turn on solid. Pressing Power Switch 25 a fourth time or sliding Power Switch 25 to a fourth position may activate a fourth circuit that causes LED's 22 to and turn off in a random pattern, or, alternating between the other three patterns or modes described above. One skilled in the art will recognize that many different circuits with varying affects on the LED's 22 may be incorporated within Disk 10 to achieve varying light effects, or, may have simply one circuit with one light pattern or mode.

Figure 6:
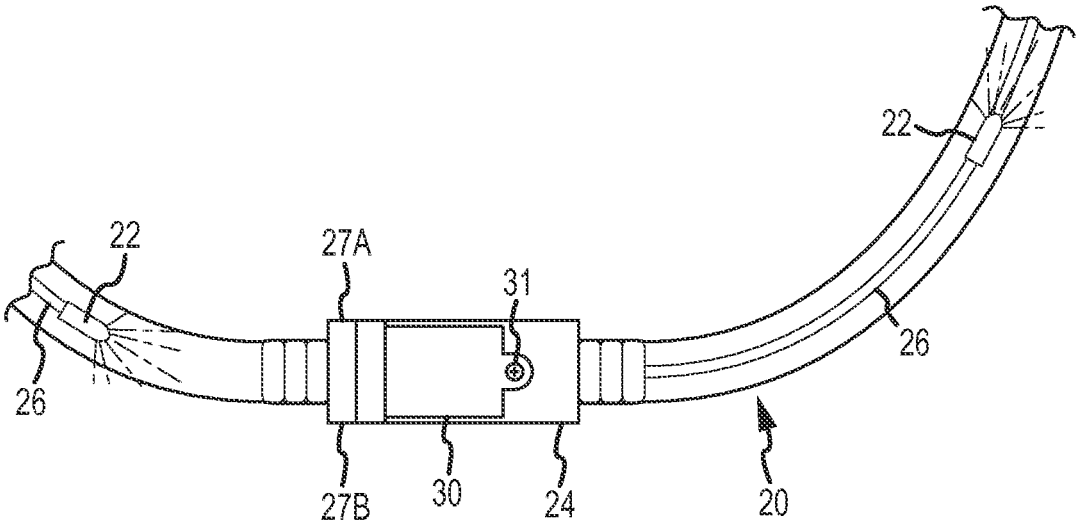
FIG. 6 shows the side of the power switch having a removable door to provide access for replacing the batteries.

FIG. 6 shows the side of the power switch having a removable door to provide access for replacing the batteries. Referring now to FIG. 6, Battery Door 30 allows access for replacing Batteries 28 when they need to be replaced. Battery Door 30 may simply slide away, or, as shown in FIG. 6, a Screw 31 may need to be removed in order to gain access.

Figure 7:
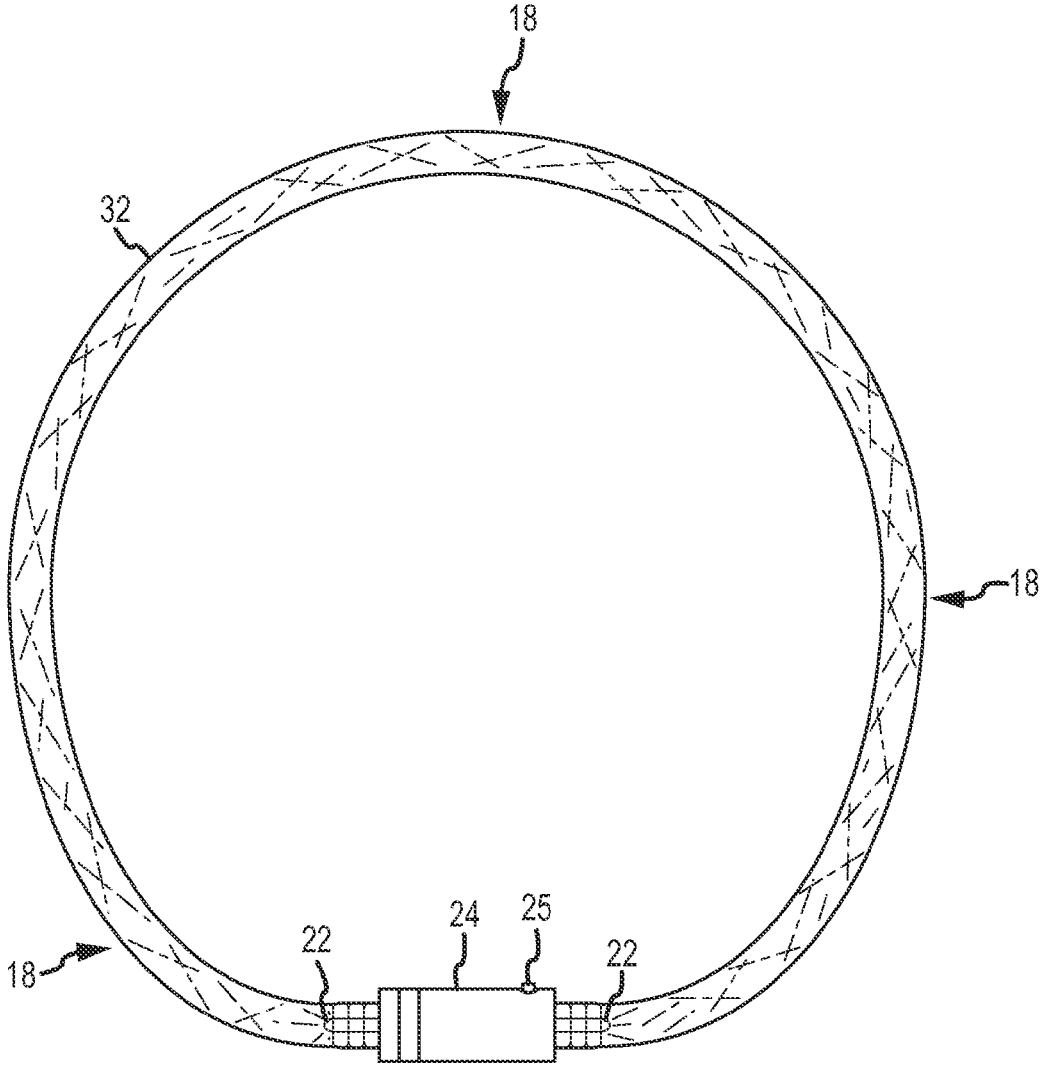
FIG. 7 shows one or more light sources illuminating a solid or hollow light emitting material.

FIG. 7 shows one or more light sources illuminating a solid or hollow light emitting material such as a thermal plastic polymer or similar light enhancing material. Referring now to FIG. 7, in another embodiment of the invention, an additional option for a light source may consist of a solid or hollow Light Emitting Material 32 such as a thermal plastic polymer, PVC, poly carbonate or similar light enhancing material. In this embodiment, only one, or more preferably, two LED's 22 may be used. Light 18 is continuously emitted throughout Light Emitting Material 32.

Figure 8:
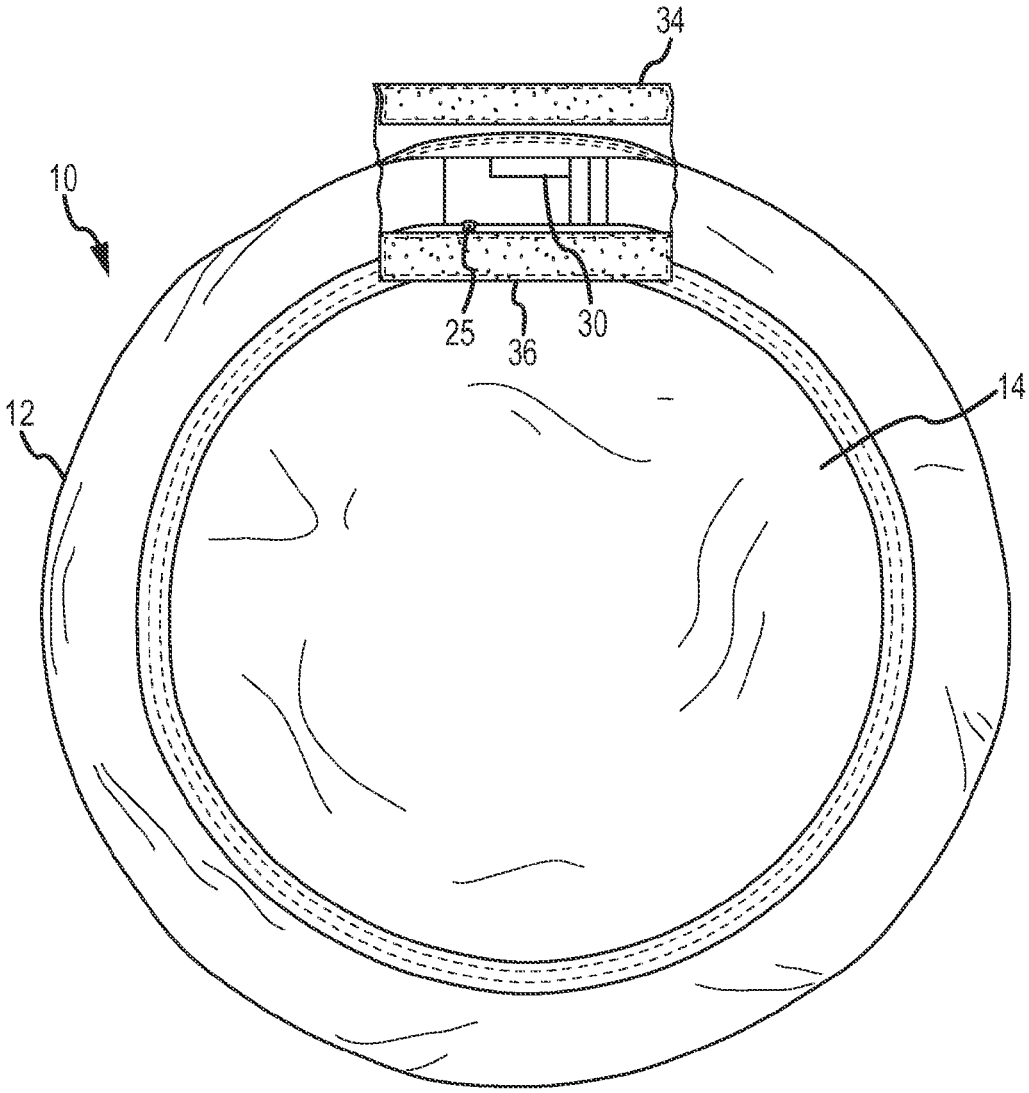
FIG. 8 shows the underside of the disk and a flap for accessing the power switch and battery door.

FIG. 8 shows the underside of the disk and a flap for accessing the power switch and battery door. Referring now to FIG. 8, Flap 34 conceals, seals, and protects Power Housing 24 and Power Switch 25. Flap 34 and Base Portion 36 typically are a hook-and-loop type connection attached to a top and bottom portion of the hollow circular fold of soft fabric of Edge 12. Flap 34 and Base Portion 36 may also consists of one or more snaps or a zipper or any other type of open-and-close connection. Flap 34 can be opened from Base Portion 36 to access Power Switch 25 and Battery Door 30 when Batteries 28 need to be replaced.

Figure 9:
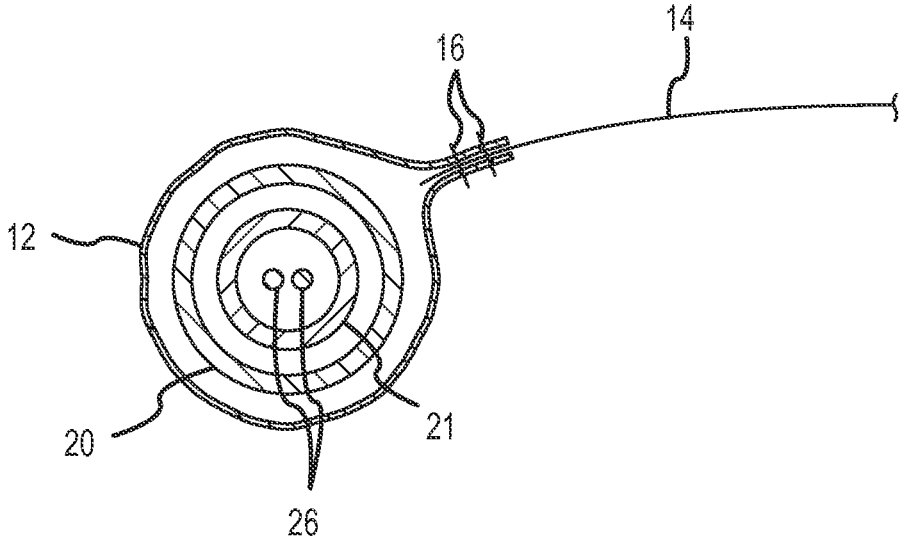
FIG. 9 shows a cross section of the edge of the disk.

FIG. 9 shows a cross section of the edge of the disk. Referring now to FIG. 9, Light Tube 21 which contains Leads 26 is itself contained within Hollow Tube 20. The hollow circular fold of soft fabric of Edge 12 overlaps Soft Body Portion 14 and the two are attached via Seam 16, shown here as a double-stitched seam.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. It will be understood by those skilled in the art that many changes in construction and circuitry and widely differing embodiments and applications will suggest themselves without departing from the scope of the disclosed subject matter.

What is claimed is:

1. A disk comprising:

a circular portion, wherein said circular portion is flexible;

an edge portion attached to the circular portion;

a first tube contained within the edge portion, wherein the first tube within the edge portion provides a semi-rigid structure for the disk, the edge portion made of a durable tear-resistant circular piece of fabric material, wherein the first tube allows light to travel through;

at least one light emitting device located within the first tube; and a power source located within the first tube and connected to the at least one light emitting device to provide power to the at least one light emitting device;

a light tube, containing the at least one light emitting device, the light tube located within the first tube, the light tube being composed of a material durable enough to withstand the pressure of an animal's biting down;

wherein the disk emits light when activated and when thrown with spin about an axis substantially perpendicular to the circular portion, the circular portion assumes a dome shape providing an aerodynamic lift effect to the disk.

2. The disk of claim 1 wherein the at least one light emitting device is a plurality of light emitting devices, along a length of the first tube, the disk further comprising:

a first circuit interconnected with the power source and plurality of light emitting devices, configured to turn the plurality of light emitting devices on and off in sequence, giving a first appearance of light traveling in a circular pattern within the edge portion;

a second circuit interconnected with the power source and plurality of light emitting devices, configured to turn the plurality of light emitting devices on and off in sequence, giving a second appearance of a strobe-like effect; and a third circuit interconnected with the power source and plurality of light emitting devices, configured to turn the plurality of light emitting devices on and off in sequence, giving a third appearance of a solid ring of light.

3. The disk of claim 2, further comprising:

a fourth circuit interconnected with the power source and plurality of light emitting devices, configured to turn the plurality of light emitting devices on and off in sequence, giving a fourth appearance of the plurality of light emitting devices being activated in a random fashion.

4. The disk of claim 1 wherein the disk has said first tube, and said first tube has a first and second end, and the first and second end interconnect to form a circle.

5. The disk of claim 4 wherein the first and second end have a snap type interconnection.

6. The disk of claim 4 wherein the edge portion includes a hollow circular fold of fabric, and the first tube is inserted into the hollow circular fold of fabric.

7. The disk of claim 6, further comprising:

a flap oriented in the hollow circular fold of fabric, wherein the flap is configured to be opened and configured to be secured using an open-and-close type connection; and a power switch, located such that the flap covers the power switch when the flap is closed, with the power switch interconnected with the power source.

8. The disk of claim 7, further comprising:

a battery door, located such that the flap covers the battery door when the flap is closed.

9. The disk of claim 1 wherein the at least one light emitting device is a plurality of light emitting devices, and the plurality of light emitting devices are located along the length of the light tube interconnected along a set of leads, wherein the first tube provides durability to the light tube.

10. The disk of claim 1 wherein the light tube is composed of a light emitting material that is light enhancing.

11. The disk of claim 10 wherein the light emitting material is selected from the group consisting of thermal plastic polymer, PVC, and poly carbonate.

12. The disk of claim 9 wherein the light tube is waterproof.

13. The disk of claim 1 wherein the first tube is bendable and flexible.

* * * * *